US006235679B1

(12) United States Patent
Mano et al.

(10) Patent No.: US 6,235,679 B1
(45) Date of Patent: May 22, 2001

(54) THERMAL TRANSFER IMAGE RECORDING METHOD

(75) Inventors: Shigeru Mano; Tomomi Yoshizawa; Yorihiro Yamaya, all of Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/237,589

(22) Filed: Jan. 26, 1999

(30) Foreign Application Priority Data

Jan. 28, 1998 (JP) ..... 10-015715
Jan. 28, 1998 (JP) ..... 10-015716

(51) Int. Cl.[7] ..... B41M 5/035; B41M 5/38
(52) U.S. Cl. ..... 503/227; 428/913; 428/914
(58) Field of Search ..... 8/471; 428/195, 428/913, 914; 503/227

(56) References Cited

U.S. PATENT DOCUMENTS 4,880,769 * 11/1989 Shuttleworth ..... 503/227
5,534,479 * 7/1996 Dix ..... 503/227

* cited by examiner

*Primary Examiner*—Bruce H. Hess
(74) *Attorney, Agent, or Firm*—Jordan B. Bierman; Bierman, Muserlian and Lucas

(57) ABSTRACT

A thermal transfer image recording method is disclosed. The method comprises steps of (1) contacting the surface of an ink layer of an ink sheet which comprises a support having thereon the ink layer comprising a thermal diffusible dye precursor to the surface of an image receiving layer of an image receiving sheet which comprises a support having thereon the image receiving layer containing a dye fixing agent capable of reacting with the dye precursor to form a dye, (2) imagewise heating the ink sheet contacting with the image receiving sheet by a heating means, (3) separating the ink sheet from the image receiving sheet, (4) contacting the surface of the image receiving layer to a resin coated surface of a protecting sheet, (5) heating the image receiving sheet through the protecting sheet with a heating means, and (6) separating the image receiving sheet and the protecting sheet, in which an optical density of an area of the image recorded on the image receiving layer RD and an optical density of an image formed on the protecting sheet SD satisfy the following equation, $$0.5\% \leq IDT \leq 8\%$$

provided IDT=SD/(RD+SD)×100.

12 Claims, 2 Drawing Sheets

THERMAL TRANSFER IMAGE RECORDING METHOD

FIELD OF THE INVENTION

The present invention relates to an image recording method by thermal transfer, particularly relates to a thermal transfer image recording method capable of forming an image having a high density and excellent in the storage ability.

BACKGROUND OF THE INVENTION

A technology for forming a monochromatic or color image has been known, in which an ink sheet having an ink layer containing a thermally difusible dye faced to an image receiving layer of image reciving sheet, and the ink sheet is imagewise heated by a thermal head or a laser light beam so as to transfer the dye to form an image on the image reciving layer. Such the image forming method has a fault that the sorage ability of the obtained image is insufficient when an ordinary known dye is used. As a means for improving such the fault, an image forming method using a reactive dye is proposed. In such the method, a compound such as a dye precursor, contained in the ink sheet is imagewise transferred to the image receiving sheet and reacted with a compounds so-called a dye fixing agent, contained in the image receiving sheet to form an image. For example, Japanese Patent Publication Open for Public Inspection, (JP O.P.I.) No. 9-327976, U.S. Pat. Nos. 4,880,769 and 5,534,479 propose a method in which a deprotonized cation dye is used as the dye precursor and a polymer or a oligomer of organic acid capable of protonizing the cationic dye is used as the dye fixing agent, and the cationic dye is re-protonized by thermal transfer to form an image. In JP O.P.I. No. 5-221151 proposes a method for forming an image in which a specific dye having a reactive group is used as the dye precursor and a compound having active hydrogen is used as the dye fixing agent and an image is formed by reaction of them by thermal transfer. Furthermore, JP O.P.I. Nos. 59-78893, 59-109394 and 60-2398 disclose a method for forming an image in which a thermally diffusible dye capable of chelating, hereinafter referred to a post-chelating dye, as the dye precursor and a metal ion-containing compound, hereinafter referred to a metal source, is used as the dye fixing agent, and a metal chelate is formed by reaction of them by thermal transfer to form an image.

When the image is formed by using such the reactive dye, a higher stability of the fixed dye can be obtained by raising the reaction efficiency of the dye precursor and the fixing agent. Accordingly, the storage ability of image can be raised by subjecting the image formed by the dye to a re-heating treatment. For example, JP O.P.I. No. 4-89292 proposes a method for raising the chelating rate in which an image formed by transfer of the post-chelating dye is further re-heated. In JP O.P.I. No. 10-138646, a method is proposed in which an image formed by reaction of a specific dye with a compound having active hydrogen is re-heated.

Methods using a heating roller, a heating press, heating blower and infrared rays, as a means for re-heating treatment, are disclosed in JP O.P.I. No. 4-29890 and 4-52223. However, such the methods are not suitable for practical use since the device for re-heating is installed in the thermal transfer recording apparatus. As a result, such problems are caused that the apparatus size is made larger, the safety is lowered and the coat is raised. A re-heating apparatus may be separately installed but the handling conveniency is lowered since two steps of operation is necessary to form an image. When a contact heating means such as a heating roller and a heating press is used, it is necessary to insert a protecting sheet between the heating means and the receiving sheet to prevent the contamination caused by transfer of the dye to the heating means. The use of the protecting sheet causes lowering in the handling conveniency and increasing in the cost. On the other hand, a method using a thermal head as the heating means has been proposed. For example, Japanese Examined Patent Publication No. 4-55870 discloses a method using a sublimation dye transfer paper having a frame of non coated area is sequentially provided with a frame of dye coated area and the image receiving sheet is re-heated by a thermal head through the non coated area after the transfer of image. Such the method is advantageous in the cost and handling since the re-heating treatment can be performed in the thermal transfer recording apparatus.

However, when an image is formed by using the reactive type dye, a problem is caused that the dye is inversely transferred to the protecting sheet or the non coated area of the ink sheet at the time of the re-heating since the dye is not sufficiently reacted in the transferred image area or the reacted dye is existed near the surface of the image receiving sheet.

When the inverse transfer of the dye is occurred, the density and the chroma of the image are lowered. It is necessary to transfer an excessive amount of the dye to compensate the shortened dye. The excessive transfer of the dye is useless from the viewpoint of cost. Furthermore, it is necessary to apply a higher strength of energy to excessively transfer the dye. Accordingly, the load of the thermal head is increased and the adhesion by fusion of the ink sheet with the image receiving sheet and the sticking of the back surface of the ink sheet are probably occurred. An unevenness of the image is formed after re-heating when the inverse transfer is not uniformly occurred.

SUMMARY OF THE INVENTION

The object of the invention is to solve the problem caused by the use of the reactive type dye for raising the fixing degree, and to provide a thermal transfer image recording method by which an image excellent in the density and the storage ability can be obtained without making larger the size of the apparatus.

The object of the invention is attained by a thermal transfer image recording method comprising the steps of contacting the surface of an ink layer of an ink sheet which comprises a support having thereon the ink layer comprising a thermally diffusible dye precursor, to the surface of an image receiving layer of an image receiving sheet which comprises a support having thereon the image receiving layer containing a dye fixing agent capable of reacting with the dye precursor to form a dye, imagewise heating the ink sheet contacting with the image receiving sheet by a heating means, separating the ink sheet from the image receiving sheet, contacting the surface of the image receiving layer to a resin coated surface of a protecting sheet, re-heating the image receiving sheet through the protecting sheet with a heating means, and separating the image receiving sheet and the protecting sheet, wherein an optical density of an area of the image recorded on the image receiving layer RD and an optical density of an image formed on the protecting sheet SD satisfy the following relation, $$0.5\% \leqq ITD \leqq 8\%$$

in which ITD=SD/(RD+SD)×100%.

DETAILED DESCRIPTION OF THE INVENTION

Figure 1A:
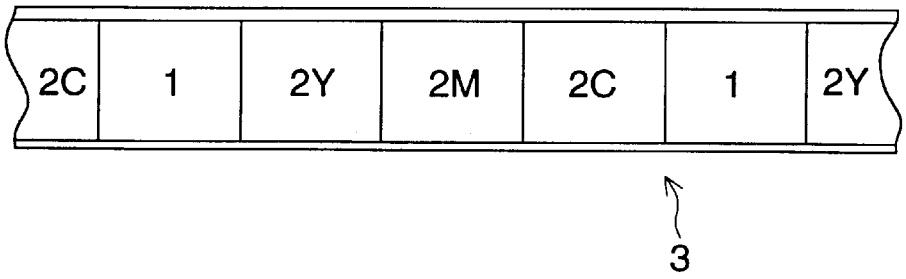
FIGS. 1*a* to 1*c* show each a plan view of an example of ink sheet usable in the invention.

The value of RD includes a density the dye formed by the reaction of the dye precursor and the fixing agent and that of the unreacted dye precursor, and does not include the density of image receiving sheet itself.

The density of SD of the image inversely transferred to the protecting sheet does not include the density of the protecting sheet itself, in other words, the difference of the measured density of the image area and the density of the non-image forming area of the image receiving sheet. The density is measured by X-rite densitometer, the density of a yellow image, magenta image and cyan image are measured each by blue, green and red light, respectively. RD is measured at the portion of image having maximum density. When the image receiving sheet is opaque, the density is a reflective density and when the image receiving sheet is transparent, the reflective density is measured by laying a white paper having a reflective density of 0.1 or less under the image receiving sheet. SD is a transmission density of the inversion transfer image formed on the protecting sheet.

When the image recording is performed according to the embodiment of the invention, an ITD value defined by the relation of an optical density RD of an image formed by the dye fixing agent and the dye precursor on the image receiving sheet and an optical density SD of an image formed by the dye precursor and the dye inversely transferred from the image area onto the protecting sheet, is within the range of from 0.5% to 8%, preferably from 1% to 4%.

$$ITD=SD/(RD+SD)\times 100\%.$$

When the ITD value is higher than 8%, it is necessary to excessively transferred to compensate the amount of dye.

It is not always preferable that the ITD value is almost 0, namely the inversely transfer of image is not occurred at all. The inventors have found that the storage ability of the re-heated image is raised and the smudging of another thing touched with the image caused by transferring of the dye is prevented when the value of ITD is larger than 0.5%. It is conjectured that the above-mentioned problems caused by a slight amount of unreacted dye precursor and reacted dye remaining on the surface of the image receiving layer and the problems can be solved by designedly removing such the remaining matter by the inversely transfer.

In the invention, the re-heating treatment is performed through the protecting sheet contacted with the image receiving surface of the image receiving sheet by means of a heating means such as a thermal head. The thermal head for transferring the dye or another thermal head for re-heating either may be used for re-heating.

The protecting sheet to be used in the invention comprises a support and a binder resin layer provided thereon. As the support of the protecting sheet, materials similar to those used as the support of the known ink sheet using a thermally diffusible dye without any limitation. Examples of the support preferably usable in the protecting sheet include thin paper such as condenser paper, glassine paper and paraffin paper, a expanded or unexpended film of a polyester having a high heat resistivity such as poly(ethylene tetrephthalate), poly(ethylene naphthalate), poly(butylene terephthalate), poly(phenylene sulfide), polyetherketone and polyethersulfone, and a plastic such as polypropylene, polycarbonate, cellulose acetate, a polyethylene derivative, poly(vinyl chloride), poly(vinylidene chloride), polystyrene, polyamide, polyimide, poly(methyl-pentene) and an ionomer, and a laminated film thereof. The support examples of the support include a material having a microvoid layer such as polyolefin type of polystyrene type synthetic paper.

The thickness of the protecting sheet can be optionally decided so that the strength, heat conductivity and heat resistivity thereof are made optimum, and a support having a thickness of from 1 μm to 100 μm is preferably used.

The protecting sheet may be supplied sheet by sheet or in a form of roll. When the re-heating treatment is performed by the thermal head for transferring the dye image, the protecting sheet is preferably frame sequentially supplied with the kink layer for simplifying the apparatus and easily controlling thereof. In such the case, the protecting sheet is preferably the same to the material of the ink sheet for simplifying the production thereof.

Figure 1B:
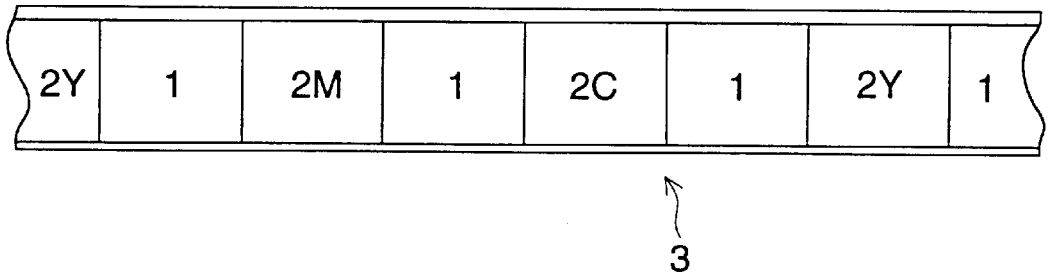
Figure 1C:
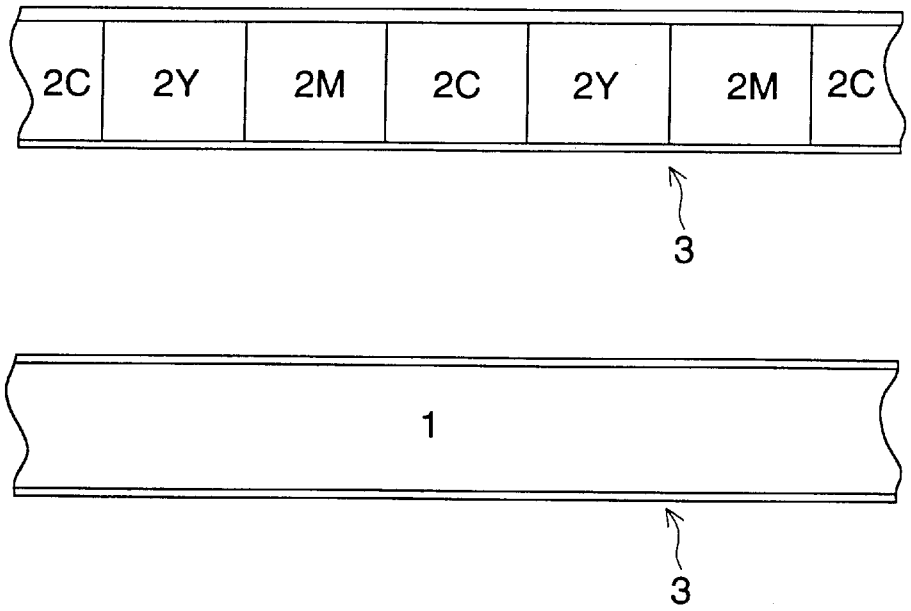

An embodiment of the invention in which the protecting sheet is supplied frame sequentially with the ink layer is described below according to drawings. FIGS. 1*a* to 1*c* are each a plan view of an example of ink sheet usable in the invention. In FIG. 1*a,* frames of ink layer of yellw 2Y, magenta 2M and cyan 2C are provided on the same surface of a support 3 and a frame of protecting sheet without dye layer 1 is positioned between the frames of ink layer 2C and 2Y. In FIG. 1*b,* frames of ink layers 2Y, 2M and 2C each containing precursors of yellow dye, magenta dye and cyan dye, respectively, are sequentially provided in this order on a same support 3 and a frames of protecting sheet are provided between each of the frames of ink layer. Although no space is provided between each of the frames in the examples shown in FIG. 1*a* and FIG. 1*b,* a space may be optionally provided between the frames for conforming the controlling method of the image recording apparatus to be used. A sensing mark is preferably provided on the ink sheet frame for exactly positioning the ink sheet. The method of marking is not specifically limited. Although in the examples shown in FIG. 1*a* and 1*b,* the protecting sheet frame and the ink layer frames are provided on the same surface of the support, the ink layers and the resin coated layer of the protecting sheet and the ink layer may be of course provided on separated supports as shown in FIG. 1*c*.

Figure 2A:
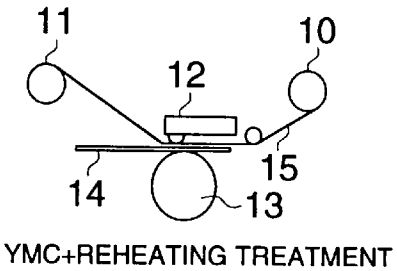
FIGS. 2*a* to 2*c* show each a schematic drawing a thermal transfer image recording apparatus.
Figure 2B:
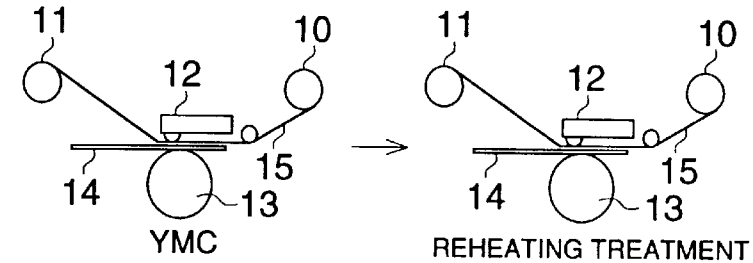
Figure 2C:
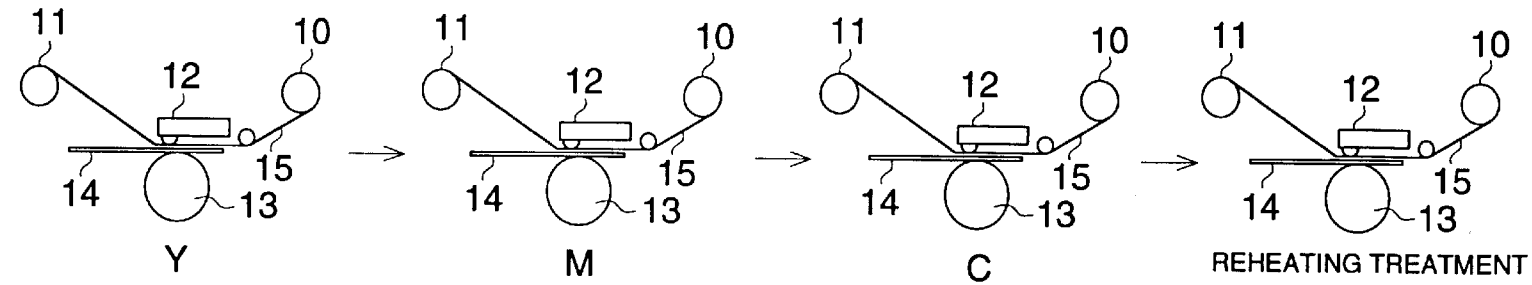

For example, an apparatus shown in FIGS. 2*a* to 2*c* can be used as the thermal transfer recording according to the invention. FIG. 2 is a schematic drawing of a thermal transfer recording apparatus. In FIGS. 2*a* to 2*c*, 10 is an ink sheet supplying roller, 15 is an ink sheet, 11 is a wind up roller for winding up the used ink sheet 15, 12 is a thermal head, 13 is a platen roller, and 14 is an image receiving roller inserted between the thermal head 12 and the platen roller 13.

When an image is formed by using the thermal transfer image recording apparatus shown in FIG. 2*a* and the ink sheet shown in FIG. 1*a,* ink sheet frame 2Y containing a yellow dye of the ink sheet is superposed on the image receiving layer of the image receiving sheet, and the yellow dye in the ink layer is transferred according to image information by heating by the thermal head to form a yellow image, then a magenta dye is imagewise transferred on the yellow image from ink sheet frame 2M containing magenta dye of the ink layer in the same manner as for the yellow image. Thereafter, a cyan dye is imagewise transferred from ink sheet frame 2C of the ink layer containing the cyan dye, and finally the images are uniformly re-heated through the protecting sheet frame 1 to complete the image formation.

When the ink sheet shown in FIG. 1(*b*) is used in the apparatus of FIG. 2(*a*), area 2Y containing a yellow dye of the ink sheet is superposed with the image receiving layer of the image receiving sheet and the yellow dye in the ink sheet is transferred to the image receiving sheet according to image information by heating by the thermal head to form a yellow image, then the yellow image is uniformly re-heated through the protecting sheet 1. Next, a magenta dye is imagewise transferred on the yellow image in the same manner as for the yellow image, then the magenta image is uniformly re-heated through the protecting sheet 1. Thereafter, a cyan dye is imagewise transferred on the transferred image from area 2C containing the cyan dye of the ink sheet, and finally the transferred image is uniformly re-heated through the protecting sheet 1 to complete the image formation.

FIG. 2(*b*) shows a procedure when an ink sheet shown in FIG. 1(*c*) is used. In such the case, area 2Y containing a yellow dye of an ink sheet is superposed with the image receiving layer of an image receiving sheet, and the yellow dye in the ink layer is imagewise transferred by heating by a thermal head to the image receiving sheet according to image information to form a yellow image, then a magenta dye is imagewise transferred on the yellow image from area 2M containing the magenta dye of the ink sheet in the same manner as for the yellow image. Thereafter, a cyan dye is imagewise transferred on the transferred images from area 2C containing the cyan dye of the ink sheet, and the transferred images are uniformly re-heated through a protecting sheet 1 by a re-heating apparatus to complete the image formation.

FIG. 2(*c*) shows procedures in which ink sheets each having a color different from each other are used and image formation is performed by apparatuses each corresponding to the different ink sheet. In this case, a yellow dye on the yellow ink sheet is imagewise transferred to an image receiving sheet according to image information to form a yellow image by transfer apparatus Y, a magenta dye on the magenta ink sheet is imagewise transferred on the yellow image by transfer apparatus M. Furthermore, a dye on the cyan ink sheet is imagewise transferred according to image information on previously transferred image by transfer apparatus C. Finally, the transferred image is uniformly re-heated by re-heating apparatus 1 to complete image formation.

In the invention, the following re-heating embodiments 1 through 3 can be taken.

(1) Heat is uniformly given to the whole image area.

(2) Heat is uniformly given to the area at which the dyes are transferred.

(3) Heating energy is controlled so as to correspond to the amount of transferred dyes.

Easiness of the control is in the order of (1), (2) and (3). (1) is most easy to control.

Binders commonly usable in the ink layer of the ink sheet can be used as the binder of the resin layer provided on the protective sheet. Examples of such the resin include an adduct of cellulose, a cellulose resin such as a cellulose ester and a cellulose ether, a polyvinyl alcohol), a polyvinylacetal resin such as a polyvinylformal, a polyvinylacetoacetal and a polyvinyl-butyral, a polyvinylpyrrolydone, a polyvinyl acetate), a polyacrylamide, a styrene resin, a vinyl resin such as poly (metha)acrylate, poly((metha)acrylic acid), a copolymer of (metha)acrylic acid, a rubber resin, an ionomer resin, an olefin resin, and a polyester resin.

A resin having a glass transition point Tg within the following range is preferably used for the resin layer of the protecting sheet.

$$100^\circ\ C. < Tg < 300^\circ\ C.$$

A resin having a solubility parameter of from 5.4 to 9.4, a resin capable of being dissolved in a solvent having a solubility parameter of from 5.4 to 7.8, a resin having a solubility parameter of not less than 13.0, and a resin capable of being dissolved in a solvent having a solubility parameter of not less than 13.0, are also preferably used as the resin layer of the protecting sheet.

The solubility parameter of compound can be measured experimentally. The solubility parameter of a solvent which has the highest miscibility with a compound is determined as the solubility parameter of the compound. It is considered that the solubility parameter of solvent is a indicator of the polarity of the solvent. Therefore, compounds being close in the solubility parameter are highly miscible with together. The solubility parameter of resin is experimentally determined by the following procedure.

A resin to be determined is mixed with various kinds of solvent each are different in the solubility parameter thereof, and turbidity of each of the mixture is measured. The turbidity is plotted with respect to the solubility parameter of the solvent and the point of solubility parameter at which the turbidity becomes to minimum is determined by interpolation. Such the point is defined as the solubility parameter of the resin.

Solubility parameters of solvents and resins are described in "Coating no kiso kagaku (Fundamental Science of Coating)" Maki Shoten, "Setchaku kanri (Control of Adhesion)" Shin Koubunshi Bunko, 1990, and 'Youeki to youkaido (Solution and Solubility" Maruzen.

In an embodiment of the invention, it is preferable to use a binder resin in the resin layer of the protection sheet having a solubility parameter of from 5.4 to 9.4, or a solubility parameter of not less than 13.0, or a resin soluble in a solvent having a solubility parameter of from 5.4 to 7.8 or soluble in a solvent having a parameter not less than 13.0.

The solubility parameter is determined by the solvent described on page 411 of "JSR Hand Book".

The dissolution of the resin is visually judged by the turbidity of the solution when 5 weight percent of powdered resin is added to the solvent at an ordinary temperature and stirred.

The solvents to be used for the test and the solubility parameter of each of the solvents are as follows:

Freon 12 5.4

Propane 6.4 n-Decane 6.6 n-Butane 7.0

Freon 113 7.3

Diethyl ether 7.4

Freon 11 7.6 n-Octane 7.6

Isoamyl acetate 7.8

Methylcyclohexane 8.2

Maleic anhydride 13.6

Methanol 14.6

Ethylene glycol 14.6

Glycerol 16.5

Formamide 19.2

Water 23.4

It is preferable to add the following silicone compound into the resin layer of the protecting sheet for controlling the amount of inversion transfer of dye to the protecting sheet and inhibiting adhesion of the protecting sheet with the image receiving sheet.

The silicone compound includes a type for direct addition and a type for reactive hardening.

As the directly adding type silicone oil, a modified silicone oil is preferably used for improving the miscibility with the binder. Examples of the modified silicone compound include a polyester-modified silicone resin or a silicone-modified polyester resin, an acryl-modified silicone resin or a silicone-modified acryl resin, a urethane-modified silicone resin or a silicone-modified urethane resin, a cellulose-modified silicone resin or a silicone-modified cellulose resin, an alkyd-modified silicone resin or a silicone-modified alkyd resin, and an expoxy-modified silicone resin or a silicone-modified epoxy resin.

Examples of the reactive hardening type silicone compound include the following ones having a reactive group.

(a) Amino-modified silicone having an amino group

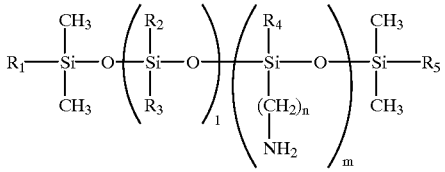

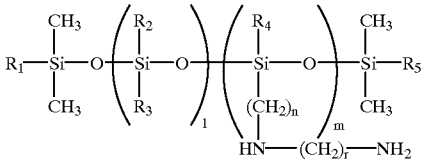

(b) Epoxy-modified silicone having an epoxy group

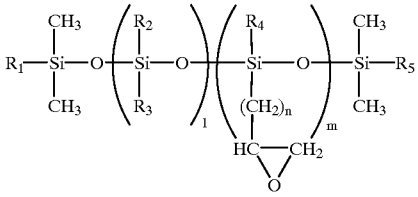

(c) Examples of a modified silicone oil other than the above-mentioned include ones represented by the following formula in which $R_6$ is a reactive group, for example, an isocyano-modified silicone in which $R_6$ is an —NCO group, a alcohol-modified silicone oil in which $R_6$ is an —OH group and a carboxyl-modified silicone oil in which $R_6$ is a —COOH group.

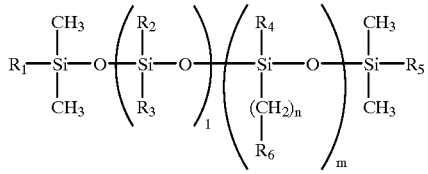

In the foregoing Formulas (a) to (c), although the group represented by $R_1$ through $R_5$ are each an organic group. Although the organic group is principally a methyl group, it may be an alkyl group other than the methyl group or a phenyl group. In the formulas, l, m and n are each an integer of 1 or more, which may be optionally decided depending on the molecular weight of the mold releasing agent. The group of atoms of the moieties of l and m are copolymerized at random.

The foregoing silicone compounds are optionally used in combination according to the reaction form of the hardening reaction. The modified silicone having an amino group or a hydroxyl group is reacted with the modified silicone having an epoxy group, an isocyanato group or a carboxyl group.

Examples of the catalyst hardening type include silicones of the following type (d) or (e).

(d) An alcohol-modified silicone capable of polymerizing by dehydration reaction of two silicone group.

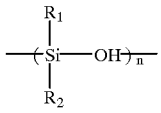

A titanate and a carboxylic salt of zinc, iron or tin are usable as the catalyst.

(e) A composition composed of a vinyl-modified modified silicone and a vinyl-modified silicone in which a part of organic group is —H

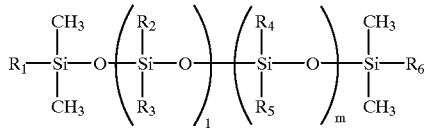

A metallic catalyst such as a platinum catalyst is usable.

In the foregoing formulas of (d) and (e), $R_1$ through $R_6$ are each an organic group. Although the groups respectively represented by $R_1$ to $R_6$ are each principally a methyl group, the group may also be an alkyl group other than the methyl group or a phenyl group. In the case of (e), at least one of the groups represented by $R_1$ through $R_6$ is a vinyl group, —CH═$CH_2$, in the vinyl-modified silicone, and at least one of $R_1^-$ to $R_6$ is a vinyl group additional to the —H atom thereof. In the formulas, l, m and n are each an integer of 1 or more, which is optionally decided depending on the molecular weight of the mold releasing agent. The group of atoms of the moieties of 1 and m are copolymerized at random.

Examples of vinyl-modified silicone other than the above include the following silicone compounds.

(1)

One terminal type

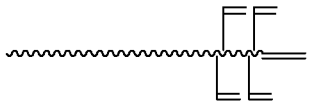

(2)

Both terminals type

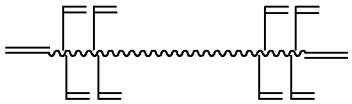

(3)

One terminal and center type

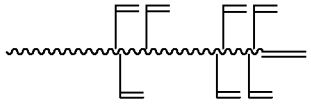

(4)

Both terminal and center type

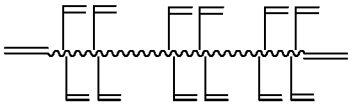

When a silicone of the above Formula (1) and that of the above Formula (2) are used in combination to be hardened, the reaction can be schematized as follows.

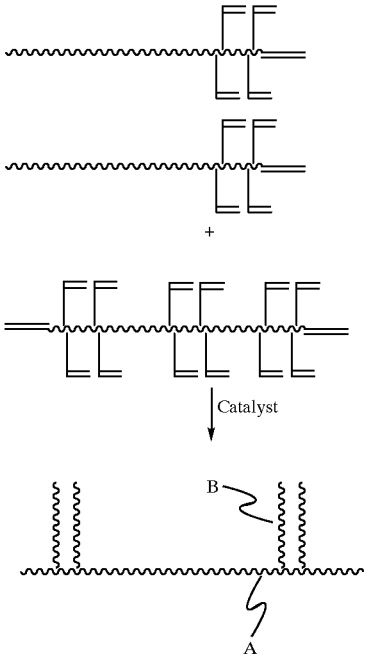

When the forgoing multi-functional silicones are used in combination, the main chain A contributes for strength of the coated layer and the pendant B contributes to the mold releasing ability, and sufficient coated layer property and releasing ability can be attained at the same time.

The silicone oil having a long chain alkyl group having 16 or more carbon atoms includes the following linear polymer of (f) to (i).

(f) A mold releasing resin composed of a polyolefin type linear polymer

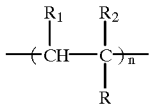

(g) A mold releasing resin composed of a polyester type linear polymer

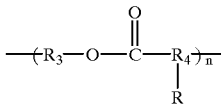

(h) A mold releasing resin composed of a polyurethane type linear polymer

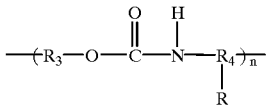

(i) A mold releasing resin composed of a polyamide type linear polymer

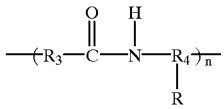

In the formulas of (f) to (I), R is a long chain alkyl group represented by $—(CH_2)_m—CH_3$ in which m is an integer of 16 or more. At least one of $R_1$ and $R_2$ is a reactive group and the others are each a hydrogen atom or an alkyl group. $R_3$ and $R_4$ are each an aliphatic or aromatic chain having a reactive group. n is an integer of 1 or more, which is optionally decided depending on the molecular weight of the mold releasing agent.

The containing amount of the foregoing silicone compound is preferably from 0.5 to 80% by weight of the solid composition of the resin layer.

A compound generally known as a mold releasing agent, for example, a solid wax such as a polyethylene wax, a polypropylene wax, an amide wax and Teflon wax, a compound having a fluoroalkyl group and a compound having a long-chain alkyl group may be contained in the resin layer of the protective sheet to prevent thermal adhesion of the protecting sheet with the image receiving layer.

In the invention, it is preferable to add a dye fixing agent in the binder resin layer of the protecting sheet for accelerating reaction of the unreacted dye precursor and/or absorbing the ureacted dye precursor to remove it. For example, when the foregoing specific dyes each having a reactive group is contained in the ink layer, the compound having active hydrogen may be added in the resin layer, and when the post-chelating dye is contained in the ink layer, the metal source may be added in the resin layer of the protecting sheet.

The dye fixing agent may be added into a layer separately provided on the protecting sheet or the silicone compound-containing layer. When the layer containing the dye fixing agent is separately provided, a binder usable in the ink layer may be used as the binder of such the layer.

The adding amount of the dye fixing agent is preferably from 0.01% to 40%, more preferably from 0.1% to 20%, by weight of the solid composition of the layer containing the fixing agent.

The support of the protecting sheet may has a subbing layer to raise the adhesiveness with the resin layer to be provided thereon. Moreover, a anti-sticking layer may be provided on a surface of the support other than the surface to be contacted with the image receiving sheet to prevent adhesion or sticking with the protecting sheet and formation of wrinkles of the protecting sheet. An anti-sticking layer the same as that used in the later-mentioned ink sheet may be applied to the protecting sheet. The thickness of the subbing layer and the anti-sticking layer are each usually from 0.1 to 1 $\mu$m.

In the invention, the ink sheet is comprises a support and an ink layer provided on the support. The ink layer contains a thermally diffusible dye precursor. A post-chelating dye is preferably used as the dye precursor.

A known sheet is usable as the support of the ink sheet without any limitation as long as it has a sufficient dimension stability and resistivity to heat at the recording by a thermal head. The ink layer basically comprises at least the post-chelating dye and a binder.

For the binder of the ink layer, for example, a cellulose adduct, a cellulose resin such as a cellulose ester and a cellulose ether, a polyvinyl alcohol, a plyvinylacetal resin such as polyvinylformal, polyvinylacetal and polyvinylbutyral, a vinyl resin such as polyvinylpyrrolidone, poly(vinyl acetate), polyacrylamide, a styrene resin, a poly (metha)acrylate, poly(metha)acrylic acid, a (metha)acrylic acid copolymer, a rubber resin, an ionomer resin, an olefin resin and polyester resin are usable.

Among these resins, polyvinylbutyral, polyvinylacetoactal and cellulose resins are preferred since they are excellent in the storage ability.

The following resins are also usable as the binder of the ink layer: a reaction product of an isocyanate and a compound having an active hydrogen atom selected from polyvinylbutyral, polyvinylformal, a polyesterized-polyol and an acrylpolyol described in Japanese Paten Publication No. 5-78437, an organic solvent-soluble macromolecular substance produced by esterizing and/or urethanizing the intramolecular hydrogen atom of a natural and/or a semi-synthesized macromolecular substance, acetyl cellulose having an acetylation degree of not less than 2.4 and a total substitution degree of not less than 2.7 described in JP O.P.I. No. 3-264393, a vinyl resin such as polyvinyl alcohol having a Tg value of 85° C., poly(vinyl acetate) having a Tg value of 32° C., and a vinyl chloride/vinyl acetate copolymer having a Tg value of 77° C., a polyvinylacetal resin such as polyvinylbutyral having a Tg value of 84° C. and a polyvinilacetoacetal having a Tg value of 110° C., a polyacrylamide having a Tg value of 165° C., a polyester resin such as an aliphatic polyester having a Tg value of 130° C., a reaction product of an isocyanate compound and a polyvinylbutyral, in which the content of vinyl alcohol moiety is from 15 to 40% by weight, described in JP O.P.I. No. 7-52564, a phenylisocya-modified polyvinylacetal resin of Formula I described in JP O.P.I. No. 7-32742, a hardened product of a composition composed of one of an isocyanate reactive cellulose and an isocyanate reactive acetal resin and one of an isocyanate reactive acetal resin, an isocyanate reactive vinyl resin, an isocyanate reactive acryl resin, an isocyanate reactive phenoxy resin and an isocyanate reactive styrene resin described in JP O.P.I. No. 6-155935, a polyvinylbutyral resin having a molecular weight of not less than 60,000, a Tg value of not less than 60° C., preferably from 70° C. to 110° C., and a content of vinyl alcohol moiety of from 10 to 40%, preferably from 15 to 30% by weight, and an acryl-modified cellulose resin.

The above-mentioned binders can be used singly or in combination of two or more kinds thereof.

A reactive dye is used as the thermally diffusible dye to be contained in the ink layer. The reactive dye is a dye capable of forming an image by reaction of a precursor of the dye contained in the ink layer with the dye fixing agent by thermal transfer. A combination of a post-chelating dye and a metal source is preferably used, although known reactive dye, including the foregoing, can be used. Known various compounds are usable as the post-chelating dye without any limitation as long as the dye can be thermally transferred. In concrete, cyan dyes, magenta dyes and yellow dyes described in, for example, described in JP O.P.I. Nos. 59-78893, 59-109349, 94974, 4-97894 and 4-89292 are usable.

Among these dyes, one capable of forming a di-dentate chelate with the metal source is preferable used. Examples of such the dye are ones represented by the following Formula 1.

Formula 1

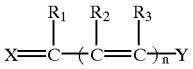

In the above formula, A is an group of atoms having a group or an atom each a capable of forming a di- or more dentate chelate, Y is a group of atoms necessary to form an aromatic carbon ring or heterocyclic ring, $R_1$, $R_2$ and $R_3$ are each independently a hydrogen atom, a halogen atom or a monovalent substituent. n is 0, 1 or 2. Y is preferably a group of atoms necessary to form a 5- or 6-member aromatic carbon ring or heterocyclic ring, which may have a substituent.

The group represented by X is preferably one represented by the following Formula 2.

Formula 2

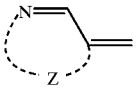

In the above formula, Z is a group of atoms necessary to form an aromatic nitrogen-containing heterocyclic ring having a substituent containing a nitrogen atom capable of forming a chelate.

Examples of such the ring include a benzene ring, a pyridine ring, a pyrimidine ring, a furan ring, a thiophene ring, a thiazole ring, an imidazole ring and a naphthalene ring. These rings each may be condensed with a carbon ring such as a benzene ring or a heterocyclic ring such as a pyridine ring.

Examples of the substituent of such the ring include an alkyl group, an aryl group, an acyl group, an amino group, a nitro group, a cyano group, an acylamino group, an alkoxyl group, a hydroxyl group, an alkoxycarbonyl group and a halogen atom. These group each may have a substituent thereof.

Example of the halogen atom represented by $R_1$, $R_2$ or $R_3$ include a fluorine atom and a chlorine atom, and those of a mono-valent substituent represented by $R_1$, $R_2$ or $R_3$ include an alkyl group, an alkoxyl group, a cyano group and an alkoxycarbonyl group.

Groups represented by the following Formula 3, 4, 5 or 6 are preferable as the group represented by X═.

Formula 3

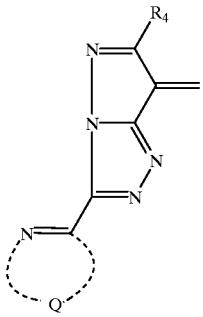

Formula 4

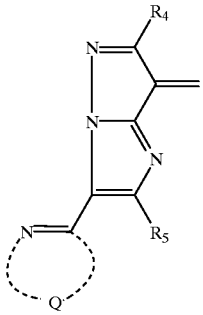

Formula 5

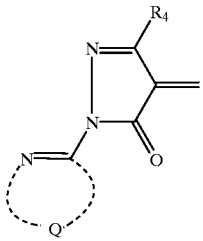

Formula 6

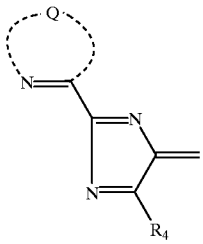

In the above-mentioned formulas, $R_4$ and $R_5$ are each a hydrogen atom, a halogen atom such as a fluorine atom, chlorine atom and a bromine atom, or a mono-valent substituent such as an alkyl group, an aryl group, an amino group, a nitro group, a cyano group, an acylamino group, an alkoxyl group, a hydroxyl group, and an alkoxycarbonyl group.

Examples of the post-chelating dye are shown below.

(1)

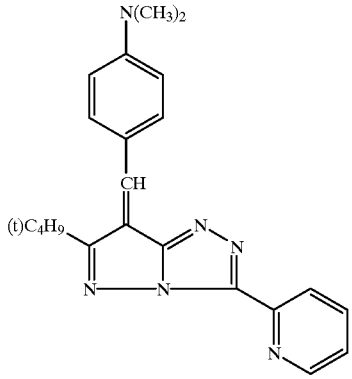

(2)

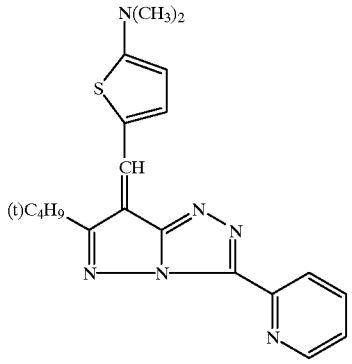

(3)

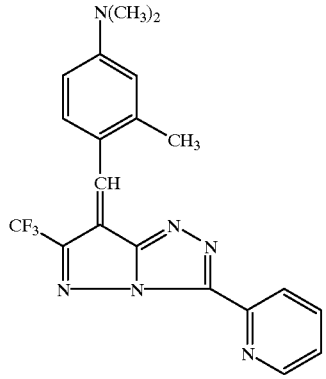

(4)

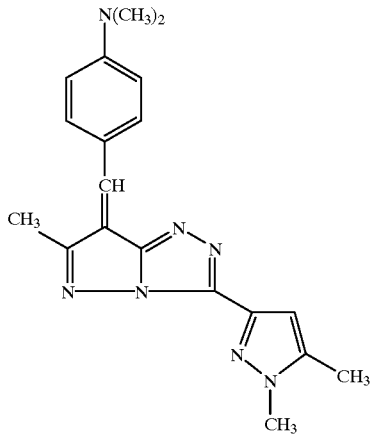

-continued
(5)
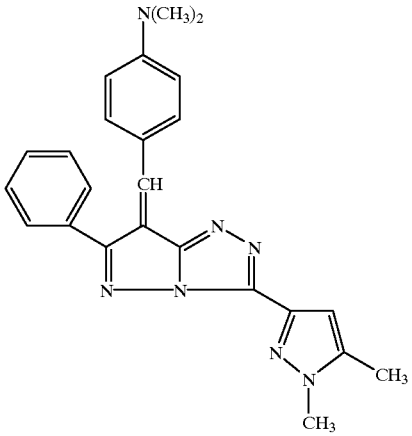
(6)
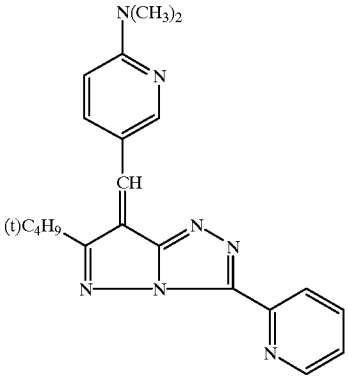
(7)
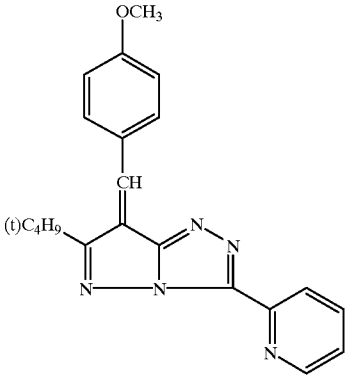
(8)
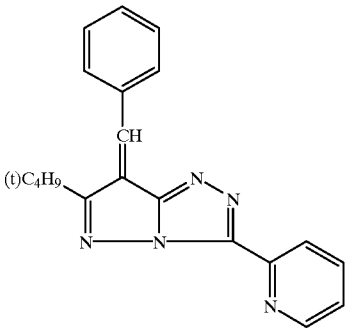
-continued
(9)
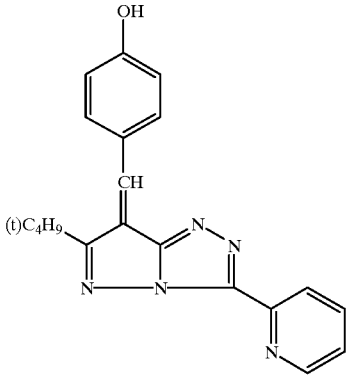
(10)
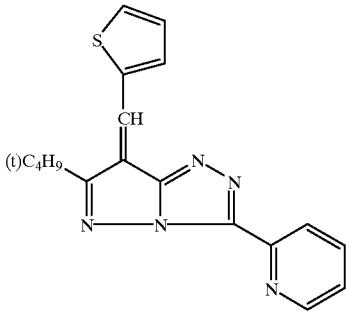
(11)
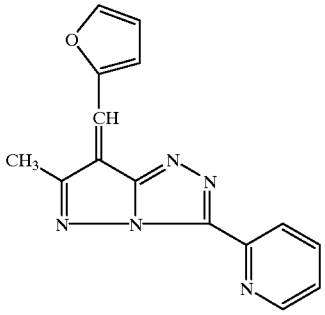
(12)
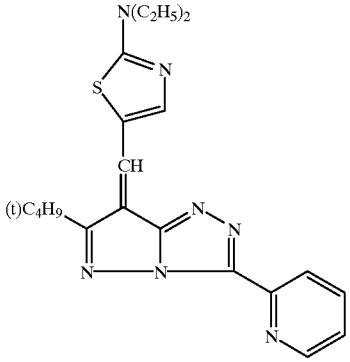

-continued
(13)
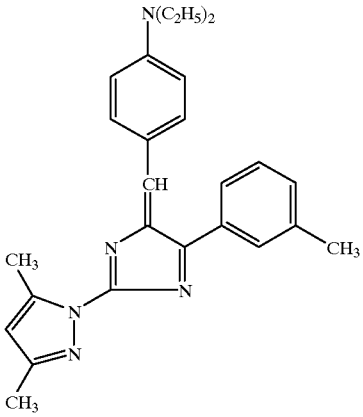
(14)
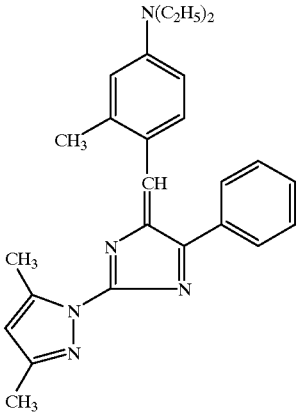
(15)
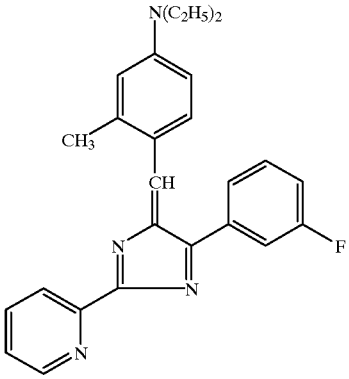
-continued
(16)
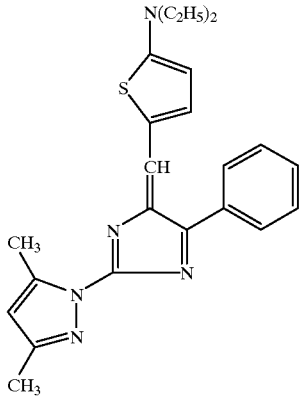
(17)
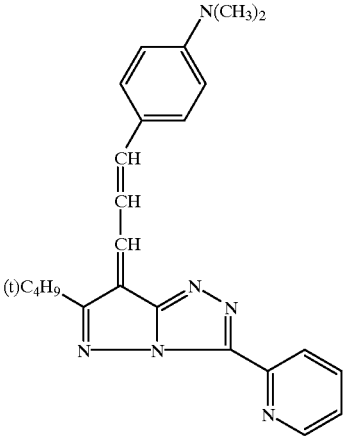
(18)
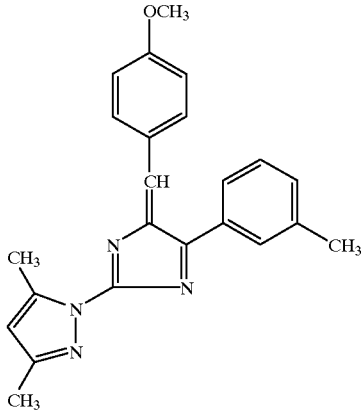

-continued (19)

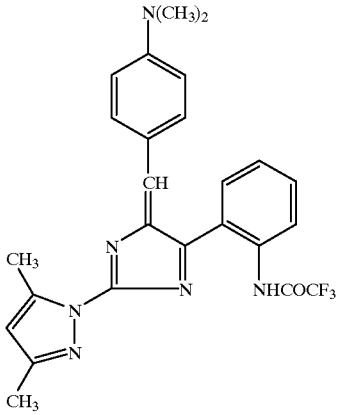

(20)

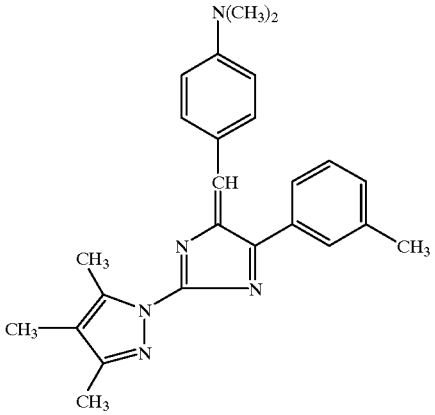

(21)

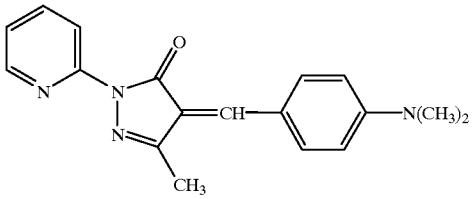

(22)

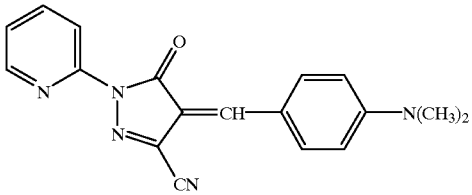

(23)

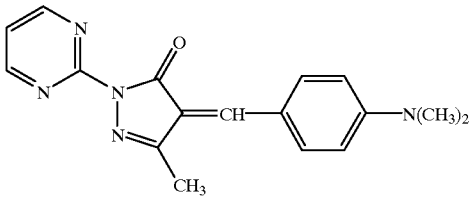

-continued (24)

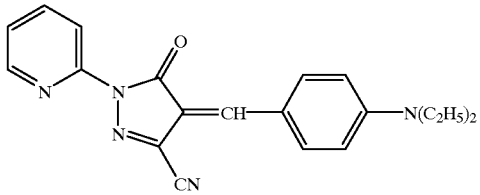

(25)

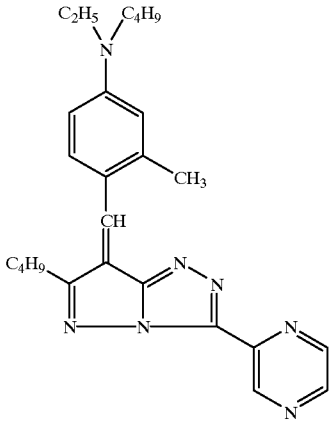

(26)

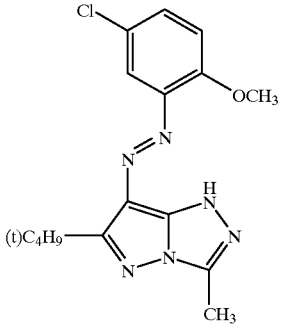

(27)

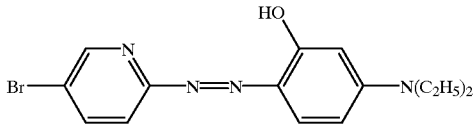

(28)

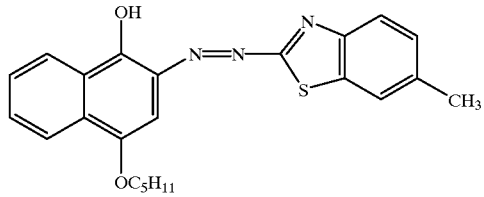

The post-chelating dye is usually used in an amount of from 10% to 80% by weight of the whole compositions contained in the area containing the post chelate dye, even though the content of the post-chelating dye may be changed depending on the property of the dye, the solubility of the dye in the binder or the purpose of use.

Various kinds of additive other than the above-mentioned may be optionally further added to the ink layer. The additives include the foregoing mold releasing agent such as a silicone compound including reaction hardenable type, a silicone-modified resin, a fluorized resin, a surfactant and a wax, a filler such as a fine metal powder, a silica gel, a metal oxide, carbon black, and a resin powder, a hardening agent capable of reacting with the binder, for example, a irradiation reactive compound such as an isocyanate compound, an acryl compound and an epoxy compound.

Another layer may be further provided on the support of the ink sheet. For example, an over-coat layer may be provided on the surface of the ink layer to prevent adhesion or blocking with the image receiving layer caused by fusion and transfer of dye to the back side of another sheet. A subbing layer may be provided on the support of the ink sheet for improving an adhesion ability of the support to the ink layer and for preventing transfer of the dye precursor to the support. Furthermore, an anti-sticking layer may be provided on the back side, opposite to the ink layer provided side, for preventing fusion adhesion and sticking of the thermal head to the support and formation of a wrinkle of the support. The thickness of the over-coat layer, the subbing layer and the anti-sticking layer are each ordinary from 0.1 $\mu$m to 1 $\mu$m.

The anti-sticking layer may comprise a binder resin such as a cellulose resin, a vinyl resin, an acryl resin, a polyamide resin, a vinyltoluene resin, a cromaindene resin, a polyester resin, a polyurethane resin, a silicone-modified urethane resin and a fluorine-modified urethane resin, and a solid or liquid mold releasing agent or lubricant, for example, a wax such as a polyethylene wax and a paraffin wax, a higher fatty alcohol, an polysiloxane, a surfactant such as an anionic, cationic, nonionic, betaine and fluorine-containing surfactant. A binder resin having a reactive group may be used together with a cross-linking agent to form a cross-linked resin.

The ink sheet is prepared by coating a coating liquid for forming the ink layer on the support by, for example, a gravure printing method and drying the coated layer. The coating liquid of ink layer is prepared by dispersing or dissolving the above-mentioned components in an solvent. The thickness of the ink layer is preferably 0.2 to 10 $\mu$m, more preferably 0.3 to 3 $\mu$m.

A low molecular weight substance having a melting point of from 50° C. to 150° C. may be added to the ink layer of the ink sheet as a sensitizer. The sensitizer preferably has a molecular weight of from 100 to 1,500. The sensitizer is preferably used in an amount of from 1 to 100 parts per 100 parts by weight of the binder contained in the ink layer.

Although the foregoing sensitizer may be any substance as long as it has a melting point within the range of from 50° C. to 150° C., the followings are preferably usable: an origomer of thermoplastic resin such as a polyurethane origomer, a polystyrene origomer, a polyester origomer, a polyacryl origomer, a polyethylene origomer, a polyvinyl chloride) origomer, a poly(vinyl acetate) origomer, an ethylene/vinyl acetate copolymer origomer, an ethylene/acryl copolymer origomer, a polyoxyethylene origomer, polyoxypropyrene origomer and polyoxyethylenepropyrene origomer, an fatty acid such as milistic acid, palmitic acid, margaric acid, stearic acid, arachic acid, and montanic acid, a fatty acid amide such as caproic amide, caprylic amide, lauric amide, stearic amide, oleic amide and eicosanoic amide, a fatty acid ester such as methyl behenate, pentadecyl palmitate, hexacosyl stearate and [1,4-phenylene-bis (methylene dimethyl)]-bis-dimethyl carbamate, an aromatic compound such as 1,4-dichlorohexylbenzene, benzoic acid, aminobenzophenone, dimethyl terephthalate, fluorantene, a phenol and a phenoxy compound, and various kinds of wax.

The image receiving sheet comprises a support and an image receiving layer provided on the surface of the support.

The support of the image receiving sheet functions to support the image receiving layer. It is preferred that the support has a strength sufficient to be handled in a heated state since the receiving sheet is heated at the time of transferring. The material of such the support can be selected without any limitation. Examples of the material include condenser paper, a glassine paper, a sulfate paper, polyolefin or polystylene synthesized paper, high quality paper, art paper, coated paper, castcoated paper, wall paper, lining paper, synthesized resin- or emulsion-immersed paper, synthesized rubber latex-immersed paper, synthesized resin-containing paper, cardboard paper, cellulose fiber paper, a film of polyester, polyacrylate, polycarbonate, polyurethane, polyimide, polyetherimide, cellulose derivative, polyethylene, ethylene-vinyl acetate copolymer, polypropylene, polystyrene, poly(vinyl chloride), poly (vinylidene chloride), poly(vinyl alcohol), polyvinylbutyral, nylon, poly(ether ether ketone), poly(vinyl fluoride), polysulfon, polyethersulfon, tetrafluoroethylene.perfluoroalkylvinyl ether, poly(vinyl fluoride), tetrafluoroethylene.ethylene, tetrafluoroethylen.hexafluoropropylene, polychlorotrifluoroethylene, or poly(vinylidenen fluoride). Moreover, a white opaque film prepared by adding a white pigment or a filler, such as titanium white, magnesium carbonate, zinc oxide, barium sulfate, silica, talc, clay and a calcium carbonate, into the foregoing resin or a foamed sheet are usable without any limitation for raising the sharpness of the image to be formed on the sheet.

A laminated sheet composed of optional combination of the foregoing supports is also usable as the support. Typical examples of the laminated support include a laminated sheet of cellulose fiber paper and synthesized paper, and that of a cellulose fiber paper and a plastic film. Another material may be laminated on synthesized paper or plastic film to separate functions such as a cushion ability and a heat conduction ability. The thickness of the support may be optionally decided, and one having a thickness of from 10 to 300 $\mu$m is ordinarily used. The surface of the support may preferably subjected to various kinds of primer treatment or corona discharge treatment when the adhessiveness between the support and the layer provided on the support.

The image receiving layer is basically composed of a binder and various additives without any limitation as long as the layer can receive a dye diffused by heat from the ink layer of a ink sheet. The image receiving layer can be formed on the support by a coating method in which a coating liquid is prepared by dissolving or dispersing components of image receiving layer in a solvent and the liquid is coated on the support and dried, and a laminating method in which a mixture of components for forming the image receiving layer is fused and extruded onto the surface of the support for laminating thereon. The thickness of the image receiving layer formed on the support is ordinary from 0.5 to 50 $\mu$m, preferably 1 to 20 $\mu$m.

Various kinds of resin can be used as the binder of the image receiving layer. Examples of resin usable as the binder include a vinyl chloride resin, a polyester resin, a polycarbonate resin, an acryl resin, a polyvinyl acetal resin, and various kinds of heat resistive resin. Although the kind of resin can be optionally selected, a poly(vinyl acetal) resin or a vinyl chloride resin are preferred from the viewpoint of the storage ability of image. As the poly(vinyl acetal) resin, poly(vinyl acetoacetal) resin, poly(vinyl butyral) resin and poly(vinyl formal) resin are preferable. As the poly(vinyl chloride) resin, a poly(vinyl chloride) resin and a copolymer of vinyl chloride are preferable. Example of the vinyl chloride copolymer is a copolymer composed of not less than 50 mole-% of vinyl chloride monomer and another comonomer. Other than the vinyl chloride resin and, a polyester resin can also be used suitably as the image receiving layer for thermal transfer recording. For example, poly(ethylen terephthalat), poly(butylene terephthalate, compounds described in JP O.P.I. Nos. 58-188695 and 62-244696, are usable as the polyester resin. As the polycarbonate resin, for example, compounds described in JP O.P.I. No. 62-169694 are usable. As the acryl resin, for example, a polyacrylate is usable. As the heat resistive resin, various kinds of heat resistive resin are usable as long as the resin has a not excessive low softening point or glass transition point Tg, and a suitable miscibility with the foregoing vinyl chloride resin, and is substantially not colored. The "heat resistive resin" means a resin which is not yellow colored and the physical properties thereof is not extremely degraded when the resin is stored under a high temperature. As the heat resistive resin, one having a Tg of from 30° C. to 200° C., particularly from 50° C. to 150° C., is preferable. Examples of the heat resistive resin satisfying the foregoing condition include a phenol resin, a melamine resin, a urea resin and a ketone resin. Among them, a urea-aldehyde resin and ketone resin are particularly preferred. The urea-aldehyde resin can be obtained by condensation of urea and an aldehyde, principally formaldehyde, and the ketone resin can be obtained by condensation reaction of a ketone and formaldehyde.

Furthermore, the following resins can be used as the binder of the image receiving layer, a polyolefin resin such as polypropylene, a vinyl halide resin other than the above-mentioned such as poly(vinylidene chloride), a vinyl polymer other than the above-mentioned such as poly(vinyl acetate), a polystyrene resin, a polyamide resin, a copolymer resin of an olefin such as ethylene or propylene and a vinyl monomer, an ionomer, a cellulose resin such as cellulose diacetate, a polyurethane resin, a polyimide resin and an epoxy resin; a combination of a polycarbonate resin described in JP O.P.I. No. 5-246152 and an aromatic polyester resin; a polyvinylacetal resin having a carboxyl group described in JP O.P.I. No. 5-246151, a vinyl chloride copolymer containing an epoxy group described in JO O.P.I. No. 5-246150, a random copolymerized polycarbonate resin described in JP O.P.I. No. 5-131758, a polyester resin at least one of diol component and acid component contains an aliphatic cyclic group described in JP O.P.I. No. 5-64978, a polyamine resin described in JP O.P.I. No. 4-299187, a water-soluble resin composed of a hydrophobic resin liquid described in JP O.P.I. No. 4-347690, a polyamide resin having an amine value of not more than 3 described in JP O.P.I. No. 4-299188, a polyurethane resin and a polyester resin described in JP O.P.I. No. 4-299184, a macromolecular compound capable of forming a coating layer of a film described in JP O.P.I. No. 4-223194, a synthesized resin described in JP O.P.I. No. 4-131287, a urethane-modified polyester resin described in JP O.P.I. No. 4-43082, a vinyl chloride/vinyl acetate copolymer having an average polymerization degree of not more than 400 described in JP O.P.I. No. 4-135794, an acidic resin having an acid value of not less than 2 described in JP O.P.I. No. 2-107458, a reaction product of a thermoplastic resin and at least two compound each having a reactive functional group described in JP O.P.I. No. 2-107485, a thermoplastic resin having a number average molecular weight of not more than 15,000 described in JP O.P.I. No. 4-40670, an aldehyde-modified vinyl alcohol and a polyester resin having a number average molecular weight of not more than 10,000 described in JP O.P.I. No. 5-270151, a resin having a tensile strength of not less than 200 Kg/cm$^2$ described in JP O.P.I. No. 6-115272, a mixture of polyvinyl alcohol and an emulsion of a synthesized resin having a glass transition point of from −100° C. to 20° C. and a polar group described in JP O.P.I. No. 6-79974, a mixture of a dispersion of water-insoluble or slightly-soluble polyester resin and an aqueous dispersion of another thermoplastic resin described in JP O.P.I. No. 6-79974, a reaction product of a polyoxyalkylene polyol and an organic polyisocyanate described in JP O.P.I. No. 6-15966, a reaction product of a polyester resin and a polyisocyanate described in JP O.P.I. Nos. 58-215398, 61-199997, 2-178089, and 2-86494, a reaction product of a vinyl chloride/vinyl acetate copolymer having a reactive hydrogen atom and a polyisocyanate described in JP O.P.I. Nos. 1-160681, 1-123794, and 3-126587, and a polyvinylacetal having a content of polyvinyl alcohol unit of not less than 10% by weight described in JP O.P.I. No. 5-294076.

The binder resin of the image receiving layer may be cross-linked or hardened utilizing the reactive group thereof by radiation, heat moisture or a catalyst, when the resin has no reactive group the reactive group can be given. In such the case, a radiation reactive monomer such as an epoxy compound or an acryl compound and a cross-linking agent such as an isocyanate compound may be used. Such the monomer and the cross-linking agent may be added into the image receiving layer directly or in a form of closed in a microcapsule.

The image receiving layer contains the binder resin and a dye fixing agent capable of reacting with a dye precursor contained in the ink sheet. When a post-chelating dye is contained in the ink layer as a preferable embodiment of the invention, a metal source capable of form a metal chelate together with the post-chelating dye.

An inorganic or organic salt or complex salt of a metal ion is usable, among them a organic acid salt and complex salt are preferable. Although monovalent and polyvalent metal of Group I through Group VIII of the periodic table is usable as the metal source, Al, Co, Cr, Cu, Fe, Mg, Mn, Mo, Ni, Sn, Ti and Zn are preferable and Ni, Cu, Cr, Co and Zn are particularly preferable. Examples of the metal source include salts of $Ni^{2+}$, $Cu^{2+}$, $Cr^{2+}$ and $Zn^{2+}$ of an aliphatic acid such as acetic acid and stearic acid. A complex salt represented by the following Formula 7 is particularly preferred since the compound can be stably added into the image receiving layer and the compound is substantially colorless.

$$[M(Q_1)_X(Q_2)_Y(Q_3)_Z]^{P+}(L^-)^P \qquad \text{Formula 7}$$

In the formula, M is a metal ion, preferably $Ni^{2+}$, $Cu^{2+}$, $Cr^{2+}$ and $Zn^{2+}$, and $Q_1$, $Q_2$ and $Q_3$ are each a coordination compound capable of forming a coordination bond with the metal atom represented by M, which may be the same or different from each other. The coordination compound can be selected from the coordination compounds described in "Chelate Science (5)" published by Konando. $L^-$ is an organic anion group such as tetraphenylboric anion and an slkylbenzenesulfonic anion. X is 1, 2 or 3, Y is 1, 2 or 0, and Z is 1 or 0. These numbers are decided depending on that the complex salt is tetradentate or hexadentate, or on the coordination number of $Q_1$, $Q_2$ and $Q_3$. P is 1 or 2. Examples of such the kind of metal source include those described in U.S. Pat. No. 4,987,049 and compounds No. 1 through No. 99 described in JP O.P.I. No. 9-39423.

The metal source is preferably added into the image receiving layer in an amount of from 5% to 80%, more preferably from 10% to 70%, by weight of the binder of the image receiving layer. When the amount of the metal source is excessive, the color of the metal source is appeared on the white background of the image receiving layer.

A mold releasing agent, an antioxidant, a UV absorbent, a filler and a pigment may be added into the image receiving layer. A plasticizer and a thermal solvent may also be added in to the image receiving layer as a sensitizer.

The peeling ability of the image receiving layer from the ink layer of ink sheet can be improved by the addition of the mold releasing agent. The foregoing silicone compound, including one so called as a silicone resin or silicone oil, a solid wax such as polyethylene wax, propylene wax, amido wax and Teflon powder, a fluorine-containing mold releasing agent, a silicon-containing releasing agent and a combined composition of them, a fluorine-containing surfactant, a phosphate type surfactant, a coupling agent, a compound having a long chain alkyl group and a polyoxyalkyl polyol may be used as the mold releasing agent. Among them the silicone compound is preferred.

As the UV absorbent or light stabilizing agent, ones capable of absorbing UV and being thermally transferred can be used. For example, compounds described in JP O.P.I. Nos. 59-158287, 63-74686, 63-145089, 59-196292, 62-229594, 63-122596, 61-283595 and 1-20478, and known compounds as those which can be improve the storage ability of image in an image recording element such as photograph can be used. The ratio of the binder to the UV absorbent is preferably from 1:10 to 10:1, more preferably from 2:8 to 7:3.

Antioxidants described in JP O.P.I. Nos. 59-182785, 60-130735 and 1-127387 and compounds known as antioxidant which can be improve the storage ability of image in an image recording element such as photograph can be used.

As the filler, an inorganic and an organic particle can be used. Examples of the inorganic particle include silica gel, calcium carbonate, titanium oxide, acid clay, active clay, and alumina. Examples of the organic particle include a fluoro resin particle, a guanamine resin particle, an acryl resin particle and a silicone resin particle. These inorganic or organic particles are preferably added in an amount of from 0.1% to 70% by weight even though the amount is varied depending on the specific gravity of the particle. Titanium white, calcium carbonate, zinc oxide, barium sulfate, silica, talc, clay, caolin, acid clay, and active are usable as the pigment.

A phthalate such as dimethyl phthalate, dibutyl phthalate, dioctyl phthalate and didecyl phthalate, a trimellitate such as octyl trimellitate, isononyl trimellitate and isodecyl trimellitate, a pyromellitate such as octyl pyromellitate, and a ajipate are usable as the plasticizer.

The adding amount of the plasticizer is ordinary within the range of from 0.1% to 30% by weight of the binder of the image receiving layer since an excessive addition of the plasticizer causes degradation in the storage ability of image.

A slippery backing layer may be provided on the back surface of the image receiving sheet. A resin to be used such the purpose is preferably one difficultly to be dyed. Examples of such the resin include an acryl resin, a polystyrene resin, a polyolefin resin, a polyamide resin, polybutyral, polyvinyl alcohol, and a cellulose acetate resin. An amorphous polyolefin resin described in JP O.P.I. No. 7-186557 is also usable. Other than the above-mentioned, a polyvinylbutyral resin, a melamine resin, a cellulose resin and an acryl resin each hardened by a hardening treatment by a chelate, an isocyanate or radiation are also preferable. Examples of the resin available in the market include acryl resins BR85, BR80 and BR113 manufactured by Mitsubishi Rayon Co., Ltd., amorphous polyolefin resins APL6509, 130A, 291AS, and 150R manufactured by Mitsubishi Sekiyu Kagaku-kogyo Co., Ltd., and Zeonex 480, 250 and 480S, manufactured by Nihon Zeon, polyvinylbutyral resin 3000-1, manufactured by Denki Kagaku-kogyo Co., Ltd., polyvinyl alcohol resins manufactured by SMR- 20H, SMR-20HH, C-20, C-10, MA-23, PA-20 and PA-15, manufactured by Shin'etsu Kagaku-kogyo Co., Ltd., acetyl cellulose resins L-30 and LT-35, Daicel Kagaku-kogyo Co., Ltd. However usable resin is not limited to the above-mentioned.

An organic and/or inorganic filler may be contained in at least one layer provided on the back surface of the image receiving sheet to improve the suitability for automatic sheet supplier. As the filler, polyethylene wax, bisamide, nylon, acryl resin, cross-linked polystyrene, silicone resin, silicone rubber, talc, calcium carbonate and titanium oxide are usable without any limitation.

Among the above-mentioned, a nylon filler is particularly preferable for inhibiting frictional wear and change of frictional property by transfer of a sheet supplying rubber roller of a printer. Preferable a nylon filler has a molecular weight of from 100,000 to 900,000, a shape of sphere and an average particle size of from 0.01 $\mu$m to 30 $\mu$m. One having a molecular weight of from 100,000 to 500,000 and an average particle size of from 0.01 $\mu$m to 10 $\mu$m is particularly preferable. Nylon 12 is preferable compared with the Nylon 6 or Nylon 66, since Nylon 6 is excellent in the water resistivity and property change caused by water absorption is small.

The nylon filler has a high melting point and thermally stable, and is difficultly dyed by a dye since it has a high resistivity to oil and chemicals. The nylon filler has a self lubricating ability and a low frictional coefficient, and it is almost not worn by friction and does not damage a counter material. The preferable average size is from 0.1 $\mu$m to 30 $\mu$m for an image receiving sheet for reflective image and from 0.01 $\mu$m to 1 $\mu$m for an image receiving sheet for a transparency image. When the size of the filler particle is too small, sufficient slipping property cannot be obtained since the filler is buried in the backing layer, and when size is too large, the friction coefficient is raised and the filler tend to be felt out from the layer surface since the particle is largely projected from the layer surface.

The above-mentioned fillers is available in the market. For example, polyethylene wax W950 manufactured by Mitsui Sekiyu Kagaku-kogyo Co., Ltd., and nylon filler MW330, manufactured by Shinto Toryo Co., Ltd., are usable.

The adding amount of the filler is preferably from 0.01 to 200 parts by weight with respect to 100 parts by weight of resin in the layer to be added.

The center line average surface roughness Ra of the backing layer surface is preferably from 0.5 $\mu$m to 2.5 $\mu$m, and the average number of protrusion per unit area is preferably 2,000 to 4,500 per square millimeter. Such the property on the surface of the backing layer can be prepared, other than the conditioning by the filler, by a method in which the surface of a cooling roller having such the surface condition is used when the resin is coated by extrusion coating addition so as transfer the condition of the roller surface to the resin layer surface.

An interlayer may be provided between the slippery backing layer and the support to raise the adhesiveness between these layers. The interlayer is preferably formed by a reaction hardened type resin such as a thermally hardenable and/or ionized irradiation hardenable resins described in JP O.P.I. No. 6-255276 are preferably used.

Such the interlayer may be provided between the support and the image receiving layer. The image receiving layer may be subjected to a matting and/or glossiness controlling treatment by the method described in JP O.P.I. No. 4-241993.

A transparent heat absorbing substance may be contained in the image receiving layer and/or a layer adjacent to that. Heat accumulated near the heat absorbing substance expands the image receiving layer and the dye is effectively transferred into the image receiving layer.

Various kinds of near-infrared absorbing dye are used as the heat absorbing substance. For example, a nitroso compound and its metal complex, a polymethine dye, a squalilium dye, a thiol nickel salt, a phthalocyanine dye, triallylmethane dye, an immonium dye, a diimmonium dye, a naphthoquinone dye and an anthraquinone dye are usable. Moreover, various transparent heat accumulating substance, such as a chain-shaped hydrocarbon compound such as paraffin wax, an aromatic hydrocarbon such as paraxylene, a phenol, a carboxylic acid such as stearic acid, an inclusion type haydrate compound such as $C_4H_8.117H_2O$, an alcohol, a high molecular substance having a low glass transition point such as polyethylene, are also usable. Moreover, a photoreactive heat accumulation substance utilizing a photo-isomerizing reaction heat is usable.

A layer containing foams may be provided on the image receiving sheet for raising the cushion ability thereof. A thermally expandable hollow particle or a capsule-shaped hollow resin particle can be used for forming the foams. Moreover, a decomposition type foaming agent, such as dinitropentamethylenetetramine, diazoaminobenzene, azobisisobutylnitryl and azodicarboamide, which generates a gas such as oxygen, carbon dioxide gas or nitrogen, by heating.

The foams contained in the layer are preferably independent foams from the viewpoint of ability of cushion and heat insulation, for example, that described in JP O.P.I. No. 6-270559 is preferable.

Although an adhesive may be contained in the foam-containing layer, a primer layer may be provided between the support and the foam-containing layer to raise the adhesiveness between them. A primer layer described in JP O.P.I. No. 5-270152 can be used such the primer layer.

An anti-static function may be given to the image receiving sheet and/or the ink sheet. Known technology can be applied to give the anti-static function. Namely, known electric conductive substances such as a fine powder of metal, metal oxide and carbon, organic compounds so called antistatic agent such as an anionic, cationic, amphoteric and nonionic surfactant and a polysiloxane compound, fine powder of electron inorganic conductive substances such as a fine powder of titanium oxide, zinc oxide, tin oxide or indium oxide subjected to a doping treatment in which the powder is mixed with an impurity and baking to introduce an irrgulariy into the crystal lattice for raising the electron conductivity are usable. The foregoing electric conductive substances may be added into at least one of the layers of the image receiving sheet and/or the ink sheet, or a layer containing the electric conductive substance may be provided.

Of course, a combination of the above-mentioned layers is preferably used. Although the coating liquid electric conductive for forming the electric conductive layer can be prepared in an ordinary manner, it is preferable that the anti-static agent is dissolved or dispersed in a form of an alcoholic or aqueous solution into an organic solvent solution of the binder and the powder of electron conductive inorganic substance is directly dispersed into an organic solution of the binder.

The resin to be the binder of the electric conductive layer is preferably a thermally hardenable resin such as a thermally hardenable polyacrylate resin and a polyurethane resin, or a thermoplastic resin such as a poly(vinyl chloride) resin, a polyvinylbutyral resin and a polyester resin. The ratio of the binder to the electro conductive substance is preferably decided so that the surface intrinsic resistance of the electric conductive layer after coating and drying or hardening is not more than $1\times10^{10}$ Ω.cm.

The electric conductive liquid thus prepared can be coated by an ordinary coating method such as coating by a blade coater or a gravure coater, and a spray coating method.

When the electric conductive layer is provided on the support to give the anti-static function, it is preferred to coat an aqueous solution of the anti-static agent on the support or the electron conductive inorganic fine powder dispersed in a synthesized resin emulsion, a synthesized rubber latex or an aqueous solution of a water-soluble resin on the support and to dry the coated layer. An emulsion of a polyacrylate resin or that of a urethane resin is usable as the synthesized resin emulsion, and a latex of methyl methacrylate-butadiene rubber or that of atyrene-butadien rubber is usable as the synthesized rubber latex. An aqueous solution of poly(vinyl alcohol) resin, polyacrylamide resin or starch are usable as the aqueous solution of water-soluble resin. The electric conductive layer may be formed more simply by spraying an aqueous solution of the anti-static agent.

In another embodiment, an anti-static layer composed of an acryl resin and an epoxy resin described in JP O.P.I. No. 8-52945 may be used for rising the adhesiveness, when an anti-static layer is provided on the support of the image receiving sheet or the ink sheet. Such the anti-static layer can be formed by coating and drying a coating liquid which contains the foregoing principal agent and a hardening agent in a suitable ratio, on at least one of the surface of the core material or support of the image receiving sheet or the ink sheet, or on a primer layer or a adhesive layer provided on the surface of the material of the support. The anti-static layer may be provided either on the surface of the core material or the support on which the ink layer or the image receiving layer is provided, or on the surface opposite to the surface on which the ink layer or the image receiving layer is provided. In the former case, the image receiving layer or the ink layer is provided on the antistatic layer. Moreover, another layer such as a heat resistive slippery layer or a back surface slippery layer may be provided on the anti-static layer. An ordinary method can be applied for providing such the layer.

When the anti-static agent is added into the image receiving layer, the anti-static agent is soluble in an organic solvent. Examples of the organic solvent-soluble anti-static agent are described, for example, in JP O.P.I. No. 5-64979. The above-mentioned anti-static agent is preferably added into the image receiving layer in an amount of from 0.1 to 10 parts by weight per 100 parts by weight of the resin forming the image receiving layer. The anti-static effect become insufficient when the used amount is too low, and the dye acceptability the image receiving layer and the storage ability of formed image tend to degraded when the amount is excessive. It is preferable that the anti-static agent is distributed in the thick-direction of the image receiving layer so that not more than 50% by weight of the anti-static agent is contained within ⅕ of the thickness of the layer at the outer surface side.

When the layer has such the structure, a good antistatic property can be stably maintained even when plural dye images are transferred on the same area of the image receiving sheet. It is preferable to form such the structure that the drying rate of the image receiving-layer is set as slow as possible so that the anti-static agent having a molecular weight lower than that of the binder resin is distributed with a higher dense at the surface side of the image receiving layer.

EXAMPLES

Example 1

<Preparation of Ink Sheet 1>

On surface of a polyethylene terephthalate) film Lumirror 6CF531, manufactured by Toray Co., Ltd., having a thickness of 6 μm, a thermal resistive layer composed of SP 712, manufactured by Dainichi Seika Co., Ltd. On the other surface of the film, a yellow, magenta and cyan ink layers and a resin layer were coated by a gravure coating method so that each of the frame of the layers were sequentially positioned as shown in FIG. 1*a*. Coating amounts of the ink layers were each 1.1 g/m$^2$ in dried state. Thus sequentially framed Ink Sheet 1 was prepared. In the followings, the amount of the compsition is described in parts by weight.

Yellow Ink Layer
- Post-chelating dye Y-1 30 parts
- Polyvinylacetal (Denka Butyral KY-24, Denki Kagaku Kogyo Co., Ltd.) 55 parts
- Poly(methyl methacrylate) (Reseda GP503, Toa Gousei-kagaku Kogyo Co., Ltd.) 10 parts
- Urethane-modified silicone oil (Dai-Allomer SP-2105, Dainichi Seika Kogyo) 5 parts Magenta Ink Layer
- Post-chelating dye M-1 30 parts
- Polyvinylacetal (KY-24) 55 parts
- Poly(methyl methacrylate) (Reseda GP503) 10 parts
- Urethane-modified silicone oil (Dai-allomer SP-2105) 5 parts Cyan Ink Layer
- Post-chelating dye C-1 30 parts
- Polyvinylacetal (KY-24) 55 parts
- Poly(methyl methacrylate) (Reseda GP503) 10 parts
- Urethane-modified silicone oil (Dai-Allomer SP-2105) 5 parts Resin Layer The following resin layer is provided in the protecting frame for re-heating. The coating amount of the resin layer was 0.8 g/m$^2$ in dry state.

Resin Layer
- Polyvinylacetal (KY-24) 60 parts
- Poly(methyl methacrylate) (Reseda GP503) 20 parts
- Urethane-modified silicone oil (Dai-Allomer SP-2105) 20 parts <Preparation of Ink Sheet 2>

Ink Sheet 2 was prepared in the same manner as in Ink Sheet 1 except that the following resin layer is provided in the protecting frame for re-heating.

- $Ni^{2+}$ $(NH_2COCH_2)_3.2B(C_6H_5)_4$ (Metal source MS-1) 1 part
- Polyvinylacetal (KY-24) 60 parts
- Poly(methyl methacrylate) (Reseda GP503) 20 parts
- Urethane-modified silicone oil (Dai-Allomer SP-2105) 20 parts Preparation of Ink Sheet 3

Ink Sheet 3 was prepared in the same manner as in Ink Sheet 1 except that a layer of Teflon is provided as the resin layer by a spray method using New Teflon Coat, manufactured by Fine Chemical Japan Co., Ltd. The thickness of the layer was 1 μm. The coated layer was subjected to a heating treatment for 30 minutes at 150° C.

The dyes used in the ink layers were shown below.

Post-chelate dye Y-1

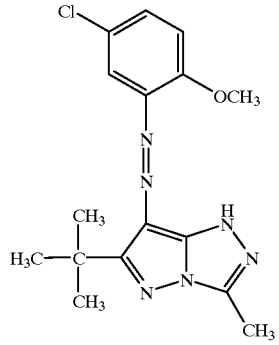

Magenta post-chelate dye M-1

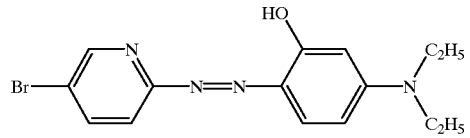

Cyan post-chelate dye C-1

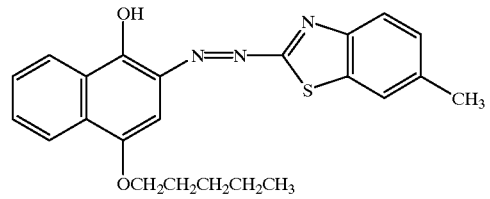

<Preparation of Image Receiving Sheet>

On synthesized paper, Crisper 2312, manufactured by Toyo Boseki Co., Ltd., having a thickness of 188 μm, an anchor layer and an image receiving layer each having the following composition were coated in this order to prepare an image receiving sheet. The anchor layer and the image receiving layer each had a thickness of 0.2 μm and 4 μm, respectively.

Anchor Layer
- Polyol-modified poly(olefin chloride) (Hardlen B-13, Toyo Kasei Kogyo Co., Ltd.) 75 parts
- Isocyanate (Colonate HX, Nihon Polyurethane Kogyo Co., Ltd.) 25 parts Image Receiving Layer
- Polyvinylbutyral (Elex BX-1, Sekisui Kagaku Kogyo Co., Ltd.) 65 parts
- Metal source MS-1 30 parts
- Polyester-modified silicone (X-24-8300, Shin'etsu Kagaku Co., Ltd.) 5 parts <Formation of Image>

The above-prepared image receiving layer of the image receiving sheet and the ink layer of the ink sheet were faced to each other and contacted by a platen roller and a thermal head having a resolving power of 12 dots/mm and an average resistivity of 3100 Ω. Then step patterns of yellow, magenta, cyan and neutral were transferred to the image receiving layer. The transfer was performed by heating with gradually varied energy of from 5 to 80 mJ/mm$^2$ from the back side of the ink sheet. The transporting speed for the transfer was 10 milliseconds/line. The neutral pattern was formed by overlapping the three color patters. Thereafter, the protective sheet area of the ink sheet was contacted to the image receiving sheet by using the same thermal head and platen roller, and the image receiving layer was re-heated by heating with energy of 80 mJ/mm2 and a transporting speed of 10 milliseconds/line from the back side of the protecting sheet frame of the ink sheet. Thus transferred image samples 1 to 3, each respectively prepared by Ink Sheets 1 to 3, were obtained.

Although no fault such as blur or lacking of image was observed in the image samples obtained.

The image obtained by Experiment 1 to 3 were evaluated by the following procedure.

<Evaluation>

Light-fastness of Image

Y, M and C images each having a density of approximately 1.0 of each of the samples were exposed to light of 70,000 Lux for 14 days in a Xenon Fade-o-meter. A remaining ration of density of each image was determined from the image densities before and after the exposure to light.

Smudge Donation

A plastic eraser "MONO" manufactured by Tombow Pencil Co., Ltd., was put on the maximum density area of the neutral image and stand for 1 hour applying a weight of 50 g/m$^2$. Thereafter, smudge formed on the eraser by the transferred dye was visually evaluated, and classified according the following standard.

A: Almost no smudge on the eraser was observed.

B: Smudge was slightly observed.

C: Smudge was clearly observed.

Results of the above-mentioned evaluation were listed in Table 1 together with the maximum density and the IDT value of each Y, M, C, and neutral color image. The maximum density is preferably not less than 1.8 in the Y, M or C image and not less than 2.0 in the neutral image. The density was measured by a densitometer X-Rite 310TR, manufactured by X-Rite Co., Ltd.

TABLE 1

| Experiment | Ink sheet | Maximum density | | | | ITD | | | | Light-fastness | | | Smudge donation | |
|---|---|---|---|---|---|---|---|---|---|---|---|---|---|---|
| No. | No. | Y | M | C | N | Y | M | C | N | Y | M | C | | Note |
| 1-1 | 1 | 1.93 | 2.08 | 2.04 | 2.28 | 3.2 | 2.9 | 3.1 | 3.2 | 93 | 90 | 85 | A | Inv. |
| 1-2 | 2 | 1.88 | 2.02 | 2.00 | 2.25 | 2.4 | 2.3 | 2.5 | 2.4 | 96 | 95 | 93 | A | Inv. |
| 1-3 | 3 | 1.96 | 1.96 | 2.14 | 2.09 | 2.30 | 0.3 | 0.4 | 0.4 | 83 | 80 | 78 | C | Comp. |

As is shown in Table 1, a high density image excellent in the storage ability having a high light-fastness a low contamination property can be obtained when the relation between the density RD of the image area formed by the dye precursor and the dye fixing agent and the density SD of the dye precursor and the dye inversely transferred on the protecting area is within the range of the invention.

Example 2

Image samples 9 through 11 were prepared in the same manner as in Example 1 except that an image receiving sheet according to the followings was used.

Anchor Layer
- Vinyl chloride/vinyl acetate copolymer resin (1000GK, Denki Kagaku Kogyo Co., Ltd.) 90 parts
- Isocyanate (Coronate HX) 10 parts Image Receiving Layer
- Vinyl chloride/vinyl acetate copolymer resin (1000GK) 65 parts
- Metal source MS-1 30 parts
- Epoxy-modified silicone (KF-393, Shin'etsu Kagaku Kogyo Co., Ltd.) 2.5 parts
- Amino-modified silicone (KS-343, Shin'etsu Kagaku Kogyo Co., Ltd.) 2.5 parts Thus obtained results are shown in Table 2.

TABLE 2

| Experiment | Ink sheet | Maximum density | | | | ITD | | | | Light-fastness | | | Smudge donation | |
|---|---|---|---|---|---|---|---|---|---|---|---|---|---|---|
| No. | No. | Y | M | C | N | Y | M | C | N | Y | M | C | | Note |
| 2-1 | 1 | 1.92 | 2.10 | 2.03 | 2.30 | 3.1 | 3.0 | 3.3 | 3.2 | 94 | 90 | 89 | A | Inv. |
| 2-2 | 2 | 1.87 | 2.01 | 1.99 | 2.24 | 2.3 | 2.3 | 2.4 | 2.3 | 96 | 96 | 93 | A | Inv. |

As is shown in Table 2, a high density image excellent in the storage ability having a high light-fastness a low contamination property can be obtained when the relation between the density RD of the image area formed by the dye precursor and the dye fixing agent and the density SD of the dye precursor and the dye inversely transferred on the protecting area is within the range of the invention even when the composition of receiving layer was changed.

Example 3

Preparation of Ink Sheet Sequentially Having Frames of Y, M, C Ink and Resin Layer Ink sheets described in Table 3 were prepared by coating a yellow, magenta and cyan ink layers each having the following composition and a resin layer composed of the resin shown in Table 3 are coated by a gravure coating method on a poly(ethylene terephthalate) film, Lumilar 6CF531 manufactured by Toray Co., Ltd., having a thickness of 6 $\mu$m so that the yellow, magenta and cyan ink layers and the resin layer are sequentially positioned as shown in FIG. 1, hereinafter referred to sequential frame. The dry thickness of the layers of the ink and the resin were each 1

μm. The film has an anti-sticking layer on one side thereof, and the ink and the resin layer were coated on the side opposite to the anti-sticking layer coated surface.

Yellow Ink Layer

Post-chelating dye Y-1 80 parts

Polyvinylacetal (KY-24 20 parts

Magenta Ink Layer

Post-chelating dye M-1 80 parts

Polyvinylacetal (KY-24) 20 parts

Cyan Ink Layer

Post-chelating dye C-1 80 parts

Polyvinylacetal (KY-24) 20 parts

Resin Layer in the frame of protecting area for re-heating

Resin described in Tables 4 and 5 100 parts

Preparation of Image Receiving Sheet

An anchor layer and an image receiving layer were coated in this order on the surface of synthesized paper, YUPO manufactured by Ooji Yuka Co., Ltd., having a thickness of 175 μm to prepare an image receiving sheet. The thickness of the anchor layer and the image receiving layer were 0.5 μm and 4 μm, respectively.

Anchor Layer

Polyvinylbutyral (Elex BL-1, Sekisui Kagaku Kogyo Co., Ltd.) 90 parts

Isocyanate (Coronate HX) 10 parts

Image Receiving Layer

Polyvinylbutyral (Elex BL-1) 60 parts

Metal source MS-1 39.5 parts

Polyester-modified silicone (X-24-8300, Shin'etsu Kagaku Co., Ltd.) 0.5 parts

Formation of Image

Solid images of yellow, magenta and cyan each having the maximum density were formed on the image receiving sheet using a thermal sublimation transfer line printer and the images were re-heated by the thermal head the same as that used for image formation. The density SD of inversely transferred image and the ITD value were determined according the foregoing definition. Thus obtained results and the Tg value or the solubility of the resin used in the resin layer are listed in Tables 3 and 4.

TABLE 3

| Exp. | | Solubility in a solvent having a solubility product of | | Solubility parameter of | Yellow image | | Magenta image | | Cyan image | | |
|---|---|---|---|---|---|---|---|---|---|---|---|
| No. | Resin | 5.4–7.8 | >13 | resin | SD | ITD | SD | ITD | SD | ITD | Note |
| 3-1 | Polyester | Insolv. | Insolv. | 12.5 | 0.10 | 7.1 | 0.05 | 3.7 | 0.15 | 9.1 | Comp. |
| 3-2 | Poly(vinyl chloride) | Insolv. | Insolv. | 9.7 | 0.12 | 8.6 | 0.06 | 4.4 | 0.20 | 11.8 | Comp. |
| 3-3 | Polyvinyl-acetal | Insolv. | Solv. | | 0.03 | 2.0 | 0.02 | 1.3 | 0.04 | 2.6 | Inv. |
| 3-4 | Nyron 66 | Insolv. | Solv. | 13.3 | 0.03 | 2.0 | 0.02 | 1.3 | 0.05 | 3.2 | Inv. |
| 3-5 | Silicone rubber | Solv. | Insoive | | 0.01 | 0.8 | 0.01 | 0.8 | 0.02 | 1.3 | Inv. |
| 3-6 | Polyethylene | Solv | Insolv. | 7.9 | 0.02 | 1.3 | 0.02 | 1.3 | 0.03 | 2.0 | Inv. |
| 3-7 | Poly(vinyl alcohol) | Insolve | Solv. | 1.3 | 0.02 | 1.3 | 0.02 | 1.3 | 0.03 | 2.0 | Inv. |
| 3-8 | Butyl rubber | | | 7.7 | 0.02 | 1.3 | 0.02 | 1.3 | 0.03 | 2.0 | Inv. |
| 3-9 | Polystyrene | | | 9.0 | 0.05 | 3.7 | 0.06 | 4.4 | 0.10 | 7.1 | Inv. |
| 3-10 | Polyacrylo-nitrile | Insolv. | Solv. | 15.4 | 0.03 | 2.0 | 0.02 | 1.3 | 0.05 | 3.2 | Inv. |

TABLE 4

| Exp. | Resin in protective | Tg of resin | Yellow image | | Magenta image | | Cyan image | | |
|---|---|---|---|---|---|---|---|---|---|
| No. | frame | (° C). | SD | ITD | SD | ITD | SD | ITD | Note |
| 4-1 | Poly(ethylen phthalate) | 70 | 0.07 | 5.1 | 0.05 | 3.7 | 0.12 | 8.4 | Comp. |
| 4-2 | Polyvinyl butyral | 85 | 0.08 | 5.8 | 0.06 | 4.4 | 0.15 | 10.3 | Comp. |
| 4-3 | Polyvinyl-acetal | 103 | 0.03 | 2.2 | 0.02 | 1.5 | 0.04 | 3.0 | Inv. |
| 4-4 | Polyvinyl-acetal | 115 | 0.03 | 2.2 | 0.02 | 1.5 | 0.04 | 3.0 | Inv. |
| 4-5 | Resin having epoxy/BPA skelton* | 175 | 0.03 | 2.2 | 0.02 | 1.5 | 0.04 | 3.0 | Inv. |

*Hardenable resin

BPA: Bisphenol A

What is claimed is:

1. A thermal transfer image recording method comprising the steps of contacting the surface of an ink layer of an ink sheet which comprises a support having thereon the ink layer comprising a thermal diffusible dye precursor to the surface of an image receiving layer of an image receiving sheet which comprises a support having thereon the image receiving layer containing a dye fixing agent capable of reacting with the dye precursor to form a dye, imagewise heating the ink sheet contacting with the image receiving sheet by a heating means, separating the ink sheet from the image receiving sheet, contacting the surface of the image receiving layer to a resin coated surface of a protecting sheet, heating the image receiving sheet through the protecting sheet with a heating means, and separating the image receiving sheet and the protecting sheet, wherein an optical density of an area of the image recorded on the image receiving layer RD and an optical density of an image formed on the protecting sheet SD satisfy the following equation, $$0.5\% \leqq IDT \leqq 8\%$$

provided IDT=SD/(RD+SD)'100.

2. The thermal transfer image recording method of claim 1, wherein said IDT is within the range of from 1% to 4%.

3. The thermal transfer image recording method of claim 1, wherein said dye precursor is a compound capable of chelating and said dye fixing agent is a metal ion-containing compound.

4. The thermal transfer image recording method of claim 1, wherein said resin layer of said protecting sheet has a glass transition point Tg of from 100° C. to 300° C.

5. The thermal transfer image recording method of claim 1, wherein the resin forming said resin layer of the protecting sheet has a solubility parameter of from 5.4 to 9.4.

6. The thermal transfer image recording method of claim 1, the resin forming said resin layer of the protecting sheet has a solubility parameter of not less than 13.0.

7. The thermal transfer image recording method of claim 1, wherein said resin layer of the protecting sheet contains a resin capable of being dissolved in a solvent having a solubility parameter of from 5.4 to 7.8 and not dissolved in a solvent having a solubility parameter of not less than 13.0.

8. The thermal transfer image recording method of claim 1, wherein said resin layer of the protecting sheet contains a resin capable of being dissolved in a solvent having a solubility parameter of not less than 13.0 and not dissolved in a solvent having a solubility parameter of from 5.4 to 7.8.

9. The thermal transfer image recording method of claim 1, wherein said resin layer of the protecting sheet contains a silicone compound.

10. The thermal transfer image recording method of claim 1, wherein said resin layer of the protecting sheet contains a dye fixing agent.

11. The thermal transfer image recording method of claim 1, wherein said ink layer and said resin layer are provided on a support in a cyclic sequence.

12. The thermal transfer image recording method of claim 1, wherein said heating means is a thermal head.

* * * * *